US009974361B2

(12) United States Patent
Zeng

(10) Patent No.: US 9,974,361 B2
(45) Date of Patent: May 22, 2018

(54) PORTABLE INFLATABLE FOLDABLE SHOES

(71) Applicant: Di Zeng, Guangxi (CN)

(72) Inventor: Di Zeng, Guangxi (CN)

( * ) Notice: Subject to any disclaimer, the term of this patent is extended or adjusted under 35 U.S.C. 154(b) by 11 days.

(21) Appl. No.: 15/229,170

(22) Filed: Aug. 5, 2016

(65) Prior Publication Data

US 2017/0224054 A1 Aug. 10, 2017

Related U.S. Application Data

(63) Continuation of application No. PCT/CN2016/073688, filed on Feb. 5, 2016.

(51) Int. Cl.

| | |
|---|---|
| ***A43B 13/20*** | (2006.01) |
| ***A43B 23/02*** | (2006.01) |
| ***A43B 1/10*** | (2006.01) |
| ***A43B 3/00*** | (2006.01) |
| ***A43B 3/12*** | (2006.01) |
| ***A43B 3/24*** | (2006.01) |

(52) U.S. Cl.

CPC ..... *A43B 23/029* (2013.01); *A43B 1/10* (2013.01); *A43B 3/0052* (2013.01); *A43B 3/12* (2013.01); *A43B 3/242* (2013.01); *A43B 3/248* (2013.01); *A43B 13/203* (2013.01); *A43B 23/0255* (2013.01)

(58) Field of Classification Search

CPC ..... A43B 13/20; A43B 13/203; A43B 13/206; A43B 23/09

See application file for complete search history.

(56) References Cited

U.S. PATENT DOCUMENTS 5,443,440 A * 8/1995 Tumey ..... A61H 9/0078 128/DIG. 20

FOREIGN PATENT DOCUMENTS

| | | | |
|---|---|---|---|
| CN | 85107433 | A | 7/1986 |
| CN | 2188864 | Y | 2/1995 |
| CN | 201216222 | Y | 4/2009 |
| CN | 201384107 | Y | 1/2010 |
| CN | 201905313 | U | 7/2011 |
| CN | 201929104 | U | 8/2011 |

(Continued)

OTHER PUBLICATIONS

1st Office Action of counterpart Chinese Patent Application No. 201610082357.8 dated Sep. 26, 2016.

(Continued)

*Primary Examiner* — Ted Kavanaugh

(57) ABSTRACT

A portable inflatable foldable shoe, including an inflatable shoe-shaped soft bag and solid bearing blocks, where the inflatable shoe-shaped soft bag is of a hollow cavity structure and includes a sole and a vamp; more than two solid bearing blocks are arranged, the sole is divided into a middle supporting cavity and a supporting folding cavity by the solid bearing blocks, the region connected with the two regions of a front sole region and a heel region is the middle supporting cavity, the region connected with the adjacent bearing blocks is the supporting folding cavity, each solid bearing block has upper, lower, left and right surfaces, and is tightly adhered to the corresponding inner wall of the shoe-shaped cavity of the sole, and each solid bearing block is provided with more than one air passage that run through the entire block.

17 Claims, 8 Drawing Sheets

(56) References Cited

FOREIGN PATENT DOCUMENTS

| | | | | | |
|---|---|---|---|---|---|
| CN | 201948080 | U | | 8/2011 | |
| CN | 203575726 | U | | 5/2014 | |
| CN | 105533900 | A | | 5/2016 | |
| CN | 205337798 | U | | 6/2016 | |
| CN | 105747361 | | * | 7/2016 | |
| CN | 205456443 | U | * | 8/2016 | |
| FR | 2627960 | A1 | * | 9/1989 | ..... A43B 3/02 |
| GB | 101323 | A | * | 9/1916 | ..... A43B 7/34 |
| JP | 2008237408 | A | | 10/2008 | |
| TW | 201121444 | A | * | 7/2011 | |

OTHER PUBLICATIONS

3rd Office Action of counterpart Chinese Patent Application No. 201610082357.8 dated Jul. 28, 2017.
International Search Report of PCT Patent Application No. PCT/CN2016/073688 dated Nov. 3, 2016.

* cited by examiner

PORTABLE INFLATABLE FOLDABLE SHOES

CROSS REFERENCE TO RELATED APPLICATIONS

This application is a continuation application of PCT/CN2016/073688, filed on Feb. 5, 2016. The contents of PCT/CN2016/073688 are all hereby incorporated by reference.

BACKGROUND

Technical Field

The present application relates to shoes, and specifically relates to a portable inflatable foldable shoe.

Related Art

Shoes are necessary in daily life and also a necessity when people are on a business trip and travel, but common shoes occupy a large space in luggage and are relatively heavy and inconvenient. Currently, in order to solve the problem that business people or other travelers need to carry shoes, hotels provide shoes for customers, which are mostly plastic slippers or disposable slippers. However, the plastic slippers in the hotels are not guaranteed in sanitation. Many people are infected with diseases such as beriberi and ringworm of the foot; and the disposable slippers have soles that are too thin, or they are uncomfortable and easy to slip and may cause difficulty in drying after wetting, etc.

In order to avoid the use of hotel shoes with potential sanitation hazards and solve the problem of inconvenience in carrying, someone puts forward inflatable shoes that can be compressed to be minimal when air is released. Not much space is taken when the shoes are placed in a suitcase, and the inflatable shoes can even be folded into a pocket to be carried away. For example, a model with the CN patent number ZL2013206697195 discloses a pair of inflating portable slippers made of an environment-friendly PVC material; each shoe sole is divided into three air storing regions, an inflating pipe is arranged at the left and right of each air inflating region respectively, and an air returning valve for preventing air returning is arranged at the opening of each inflating pipe and is in threaded connection with a pipe plug to become a vamp. The inflating portable slippers can be folded and compressed to be minimal when having no air, the problem of large space occupied by the slippers is solved, but the problem of unstable walking is not solved. Due to the flowing of air in inner cavities of the inflating slippers, when walking, people apply pressure to the slipper soles, the air in the cavities is not even due to moving and change of stressing points, and it is like walking on a fluctuated small air cushion and have a risk of falling down and causing an accident. Another example, a utility model with the CN patent number ZL2011200425499 discloses a pair of portable inflating slippers; the slippers have soles and vamps connected by connecting devices at two corresponding sides, inner cavities and inflating holes are arranged in the soles, the inflating holes of the inflating slippers are arranged in the soles, it is obvious that the slippers are inconvenient and not sanitary, and the slippers have to be inflated by equipping air nozzles with an inflator pump, there is no doubt that the inflator pump will occupy the space in the luggage, and the use of the slippers is more troublesome, and the portable requirement is not realized.

SUMMARY

Aiming to avoid the above-mentioned problems, the present application provides a portable inflatable foldable shoe, solving the problems of uneven air pressure and unstable walking caused by pure inflating soles, and having the advantages of small storage size, light weight and portability.

A technical solution of the present application is as follows:

A portable inflatable foldable shoe comprises an inflatable shoe-shaped soft bag and solid bearing blocks; the inflatable shoe-shaped soft bag is of a hollow cavity structure and comprise a sole and a vamp; more than two solid bearing blocks are positioned inside the inflatable shoe-shaped soft bag and are distributed in two pressure bearing main regions of a front sole part and a heel part of the sole, the sole is divided into a middle supporting cavity and a supporting folding cavity by the solid bearing blocks, the region connected with the front sole region and the heel region is the middle supporting cavity, the region connected with the adjacent bearing blocks is the supporting folding cavity, each solid bearing block has upper, lower, left and right surfaces, which are tightly adhered to the corresponding inner wall of the shoe-shaped cavity of the sole, and each solid bearing block has more than one air passage that runs through the entire block; the inflatable shoe-shaped soft bag is provided with an air hole, and the vamp, the middle supporting cavity, the supporting folding cavity, the air passages and the air hole form an integral cavity structure with air flow, and the inflatable shoe-shaped soft bag is inflated and deflated through the air hole.

The inflatable shoe-shaped soft bag is made of high strength and high tensile resistance materials. High-density polyethylene, polyetherimide, polyethylene, nylon or polyethylene nylon or a polyethylene plus nylon material can be made into a cavity structure, the whole bag interior is a complete whole, air in the bag body is completely through, and a modeling structure of the bag body can be in any shoe model, for example, a slipper, a sandal with a back strip or a shoe with fully closed vamp, etc. The manufacturing of the inflatable shoe-shaped soft bag is convenient and can produce various styles; it is simple and easy to implement without too much limitations to the process, and is suitable for the mainstream plastic container production technology at present, for example, a film like bag body material can be bound into the bag body with a glue or high frequency thermal fusion manner, and the bag body can also be manufactured by adopting a process of die blow molding integral molding. The inflatable shoe-shaped soft bag is of an integral hollow cavity structure, the cavity is completely airtight and can be inflated through the air hole in the inflatable shoe-shaped soft bag, the bag body can be expanded to a shoe shape with certain support degree, and after deflating, the inflatable shoe-shaped soft bag can be shrunk to a thin film with very small size and easiness in storage and carrying.

The middle supporting cavity is positioned in the middle of the sole part of the inflatable shoe-shaped soft bag and between the front sole region and the heel region, corresponds to the position of a foot arch, is a whole together with the inflatable shoe-shaped soft bag and is part of the shoe-shaped soft bag, air in the two is completely communicated, when air is blown to the shoe-shaped soft bag through an air nozzle, the middle supporting cavity is also inflated, the inflated middle supporting cavity achieves a supporting action and supports the front sole region and the heel region connected to each other of the sole into a flat and stiff whole, therefore, the portable inflatable foldable shoe actually has the practicability and comfort level during wearing. The part of the middle supporting cavity with contact to the foot arch can be made thicker.

The solid bearing blocks are made of a solid material capable of bearing weight pressure of a human body, having certain elasticity and ensuring a wearing comfort level and can be made of any material capable of bearing the weight of the human body, such as wood, bamboo, rubber, plastic, etc. The solid bearing blocks are designed according to a shoe shape, so that the upper, lower, left and right surfaces of the solid bearing blocks can be tightly adhered to the corresponding inner wall of the shoe-shaped cavity, therefore, the solid baring blocks are firmly fixed without moving and a wearer feels stable and comfortable during walking, and the tight adhering manner is preferably gluing or high frequency thermal fusion. The solid bearing blocks are provided with two or more air passages in the cross section parts, and due to such design, the air flow of the integral cavity structure in the inflatable shoe-shaped soft bag cannot be obstructed in a case that the solid bearing blocks are arranged in the inflatable shoe-shaped soft bag and are tightly adhered to the inner wall thereof, thereby achieving a supporting action for the whole shoe body, in addition, the whole shoe body can be fully inflated or deflated through only one air hole.

An interval distance should be retained between the adjacent solid bearing blocks, the width of the distance is set to be not smaller than the size that allows the two solid bearing blocks having certain thickness to be folded together, the distance between the adjacent solid bearing blocks is preferably more than 0.5 cm, and is further preferably 1.0-3.5 cm, due to the design of the interval space, one supporting folding cavity is formed between every two solid bearing blocks and has actions of supporting the solid bearing blocks at two sides by a supporting force formed after the cavity is inflated and preventing the solid bearing blocks from drooping, meanwhile, during storage, the solid bearing blocks having certain thickness can be folded due to the gaps between the solid bearing blocks by only releasing air in the supporting folding cavity, thereby reducing the space during storage and facilitating carrying. Preferably, the supporting folding cavity is slightly higher than the upper surfaces of the solid bearing blocks at two sides after being inflated, this characteristic fully considers the feature that compressed air is easy to compress, and after the sole of a foot steps on the supporting folding cavity, the supporting folding cavity can still form a plane same high as the solid bearing blocks.

The air hole is preferably positioned in the upper part of the vamp and preferably connected with an air sealing hose made of a soft material, it has an action that after the cavity of the portable inflatable foldable shoe is inflated with air, in a process of screwing down an air nozzle cover, part of air is leaked generally, and the inflating effect of the shoe body is affected, at this point, gas leakage can be prevented by pinching the air sealing hose to squeeze it while the air nozzle cover is screwed down till the air nozzle is screwed down. Since the air sealing hose is made of the soft material, closing force applying by a lip during air blowing is not convenient, and threads for screwing down the air nozzle cover cannot be made on the air sealing hose. If the air nozzle cover is not screwed tightly, the air sealing hose is easily polluted by dirty water and pollutant, and considering the two reasons, the present application provides a solution: an air nozzle is added to one end of the air sealing hose, the air nozzle is made of a hard material and is provided with the corresponding air nozzle cover, the air nozzle cover shields the air nozzle to prevent the air nozzle from being polluted by dirty water in use, and ensure that the air nozzle is clean enough to be put in a mouth to blow. The air nozzle is more than 1 cm long and is provided with bolt threads, the air nozzle cover is provided with corresponding nut threads, the air nozzle and the air nozzle cover are in threaded connection to ensure firm covering; they will not come off in the folding, storing, and transporting process. Meanwhile, the threaded screwing manner has very high airtightness, so that dirty water and other pollutants cannot enter and sanitation of the air nozzle is ensured. The threads on the air nozzle are positioned in a position close to the air sealing hose and far away from the tail end of the air nozzle, such design can cause the part of the air nozzle that can be covered by the air nozzle cover to be as long as possible, that is, the air nozzle that can be contained by the mouth is as long as possible and blowing is more facilitated. The top of the air nozzle cover is provided with an airtight gasket, which is made of an elastic, press-resistant and tough material and is placed in the air nozzle cover, when the air nozzle cover is screwed down on the air nozzle, the air nozzle cover extrudes the airtight gasket toward the air nozzle opening till the airtight gasket is tightly attached to the air nozzle opening, and thus air in the cavity of the shoe cannot be released from the air nozzle opening. A fixing bag is preferably arranged on the vamp, and the bag opening is blocked by a sealing piece. The fixing bag is used for tucking in and fixing the air sealing hose, the air nozzle and the air nozzle cover. The sealing piece is used for sealing the opening of the fixing bag and preventing the air sealing hose and the air nozzle from slipping out of the fixing bag, influence on walking of people due to swinging of the air nozzle is avoided and the inflatable shoe is concise and elegant in appearance. The fixing bag is preferably designed into a rectangular thin film material, of which three sides are adhered to and fixed on the vamp. One side is kept open without adhering to tuck in and take out the air sealing hose and the air nozzle from the opening. The fixing bag and the air hole are in same position, and the area of the fixing bag can cover the air hole and the air sealing hose, the air nozzle and the air nozzle cover connected with the air hole. The sealing piece is a strip thin film material, of which the width is larger than that of the fixing bag, three surfaces are adhered to and fixed on the vamp, and another surface has an opening of which one side covers the opening of the fixing bag, so that the air sealing hose and the air nozzle in the fixing bag do not easily slide out, and when the air nozzle is required to be taken out of the fixing bag for blowing, the sealing piece is turned open, and then a finger extends into the opening of the fixing bag to pull out the air nozzle. The air hole can be connected with a valve core to realize the inflating function with an inflating tool.

The portable inflatable foldable shoe is provided with a durable antiskid cushion layer, one surface of the durable antiskid cushion layer in contact with the ground is provided with antiskid textures which achieve an antiskid action during walking and an action of serving as a durable surface layer to protect the sole inflating cavity from wearing and piercing. The durable antiskid cushion layer is made of a thin soft durable material, such as plastic, silica gel, composite material or rubber.

The surface of the shoe is coated with a hydrophobic or superhydrophobic material coating or made of a hydrophobic or superhydrophobic material, the hydrophobic or superhydrophobic material can be alkane, silane, hydrofluoroalkane, ferroferric oxide nano or monocrystalline silicon, a lotus effect is used, people can easily spin-dry the shoes, the slippers are conveniently kept dry during storage and conveniently stored.

The present application has the following benefits:

1. The solid bearing blocks are arranged, thereby effectively solving the problem that other inflatable shoes are insufficient in supporting force and pressed by the body weight of a user, and the problems of uneven stressing and unstable walking of other inflatable shoes are also solved.
2. The solid bearing blocks are designed according to a shoe shape, so that the upper, lower, left and right surfaces of the solid bearing blocks can be tightly adhered to the corresponding inner wall of the shoe-shaped cavity, therefore, the solid bearing blocks are firmly fixed without moving and a wearer feels stable and comfortable during walking.
3. The solid bearing blocks are provided with two or more air passages in the cross section parts, and due to such design, the air flow of the integral cavity structure in the inflatable shoe-shaped soft bag cannot be obstructed in a case that the solid bearing blocks are arranged in the inflatable shoe-shaped soft bag and are tightly adhered to the inner wall thereof, thereby achieving a supporting action for the whole shoe body.
4. The supporting folding cavity is arranged and has actions of supporting the solid bearing blocks at two sides by a supporting force formed after the cavity is inflated and preventing the solid bearing blocks from drooping, meanwhile, during storage, the solid bearing blocks having certain thickness can be folded due to the gaps between the solid bearing blocks by only releasing air in the supporting folding cavity, thereby reducing the size during storage and facilitating carrying.
5. The middle supporting cavity is arranged, a hollow inflating cavity is adopted in a relative non-stressing part of the sole of a foot, achieves a supporting action after being inflated to support the front sole region and the heel region connected to each other of the sole into a flat and stiff whole, the volume can be compressed to be minimal after air leakage, thereby realizing the design aim of reducing the storage size, meanwhile, due to the middle supporting cavity, the solid bearing blocks are greatly reduced and the light weight of the shoe bodies is realized.
6. The cleaning air nozzle cover is designed to ensure sanitation and cleanliness of the air nozzle.
7. The airtight gasket is made of the elastic, press-resistant and tough material and is placed in the air nozzle cover, when the air nozzle cover is screwed down on the air nozzle, the air nozzle cover extrudes the airtight gasket toward the air nozzle opening till the airtight gasket is tightly attached to the air nozzle opening, and thus air in the cavity of the shoe cannot be released from the air nozzle opening.
8. The fixing bag and sealing piece are arranged to prevent the air sealing hose and air nozzle from swinging to influence walking during walking, and the portable inflatable foldable shoes are also concise and elegant in appearance, and the air nozzle is further protected from pollution.

REFERENCES IN THE DRAWINGS

1 inflatable shoe-shaped soft bag, 2 solid bearing block, 3 sole, 4 vamp, 5 middle supporting cavity, 6 supporting folding cavity, 7 through air guide channel, 8 air hole, 9 air sealing hose, 10 air nozzle, 11 cleaning air nozzle cover, 12 airtight gasket, 13 fixing bag, 14 sealing piece, 15 durable antiskid cushion layer

DETAILED DESCRIPTION

Specific embodiments are combined to further describe the present application without limiting a protection scope and application range of the present application.

Embodiment 1

Figure 1:
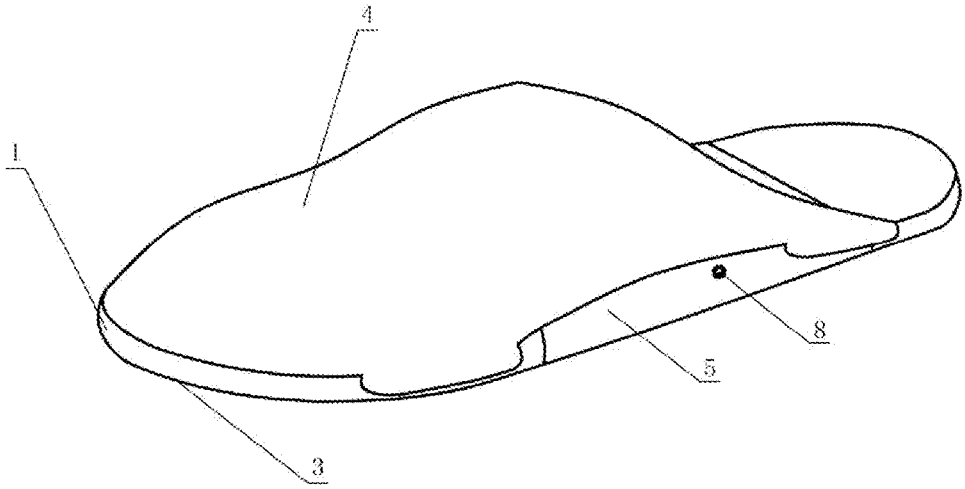
FIG. 1 is a structural schematic diagram of a portable inflatable foldable shoe of an embodiment 1 of the present application.
Figure 2:
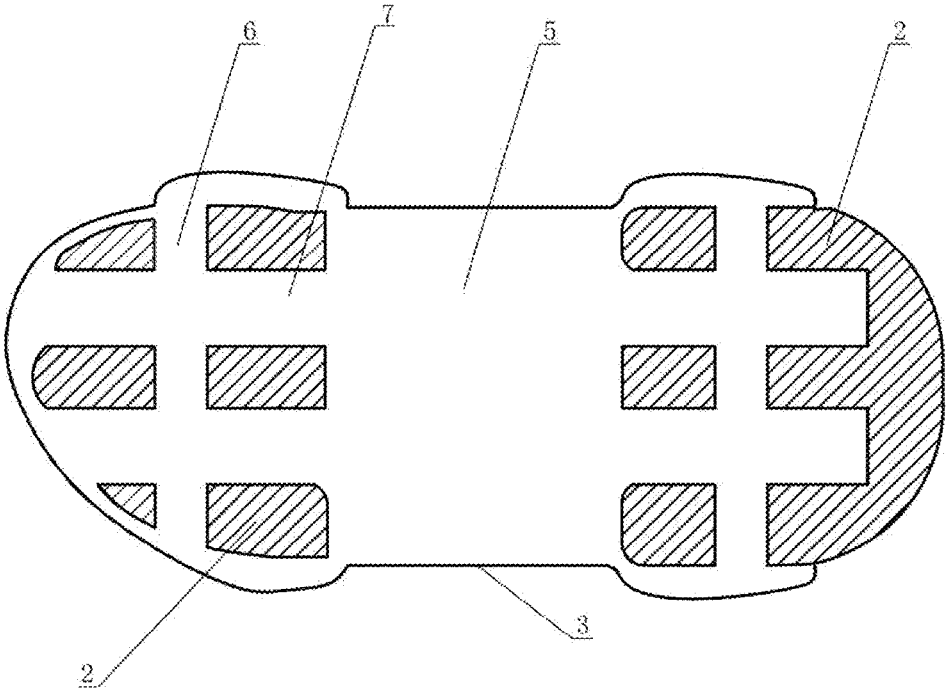
FIG. 2 is a sole cross-section schematic diagram of the portable inflatable foldable shoe of the embodiment 1 of the present application.
Figure 3:
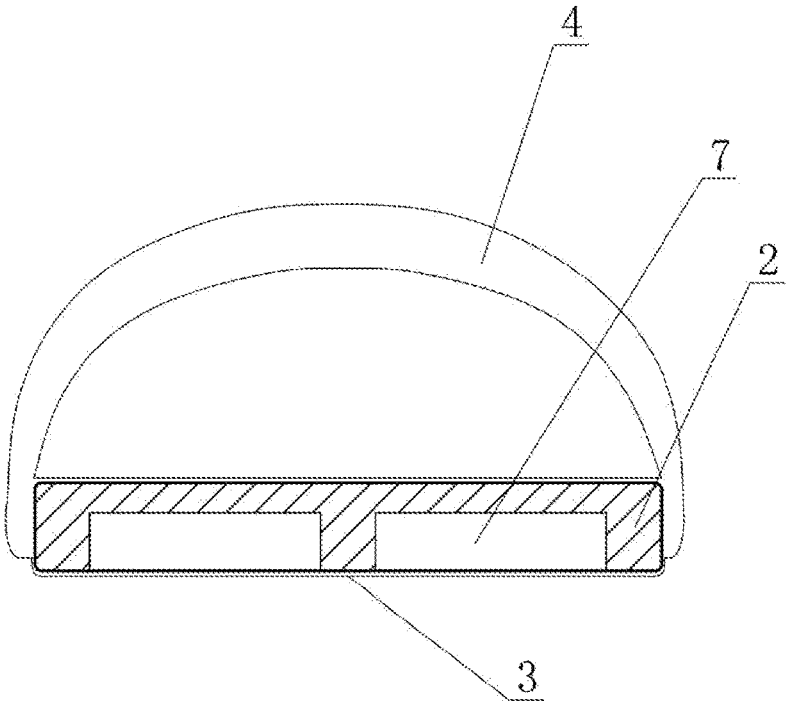
FIG. 3 is a cross-section schematic diagram of a solid bearing block of the embodiment 1 of the present application.
Figure 4:
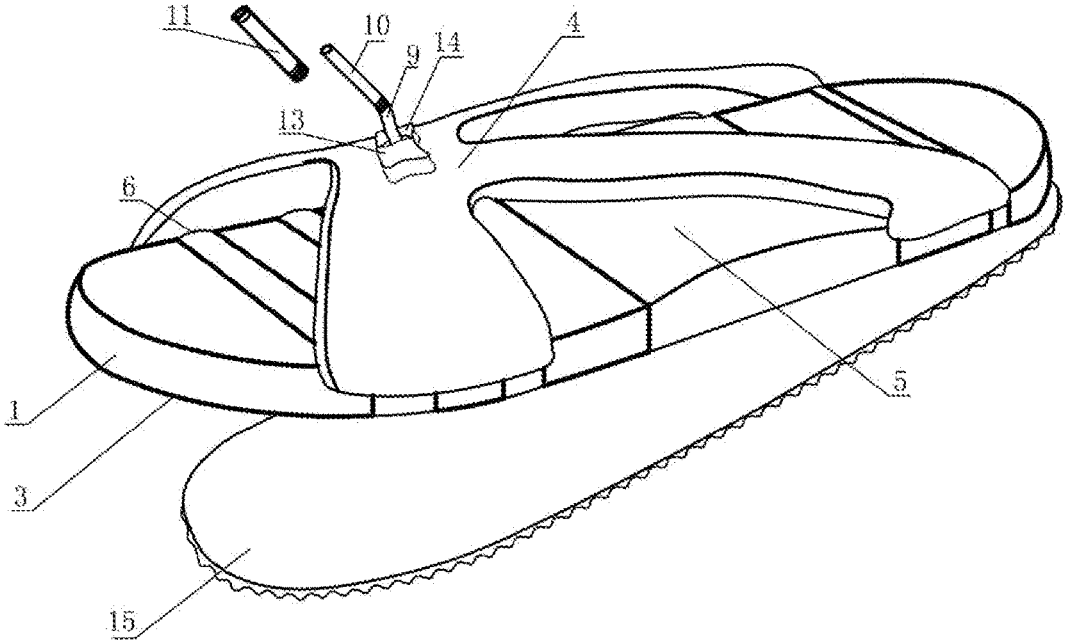
FIG. 4 is a structural schematic diagram of a portable inflatable foldable shoe of an embodiment 2 of the present application.
Figure 5:
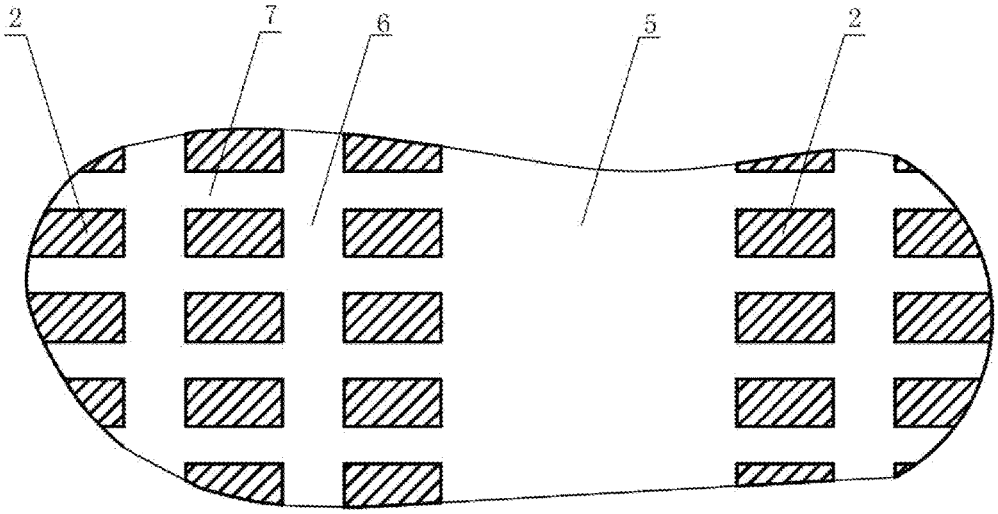
FIG. 5 is a sole cross-section schematic diagram of the portable inflatable foldable shoe of the embodiment 2 of the present application.
Figure 6:
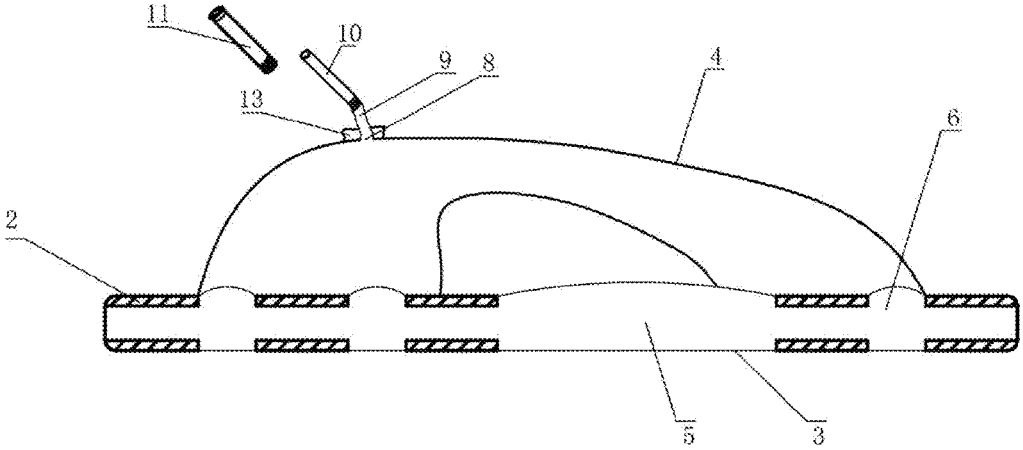
FIG. 6 is a side cross-section schematic diagram of the portable inflatable foldable shoe of the embodiment 2 of the present application.
Figure 7:
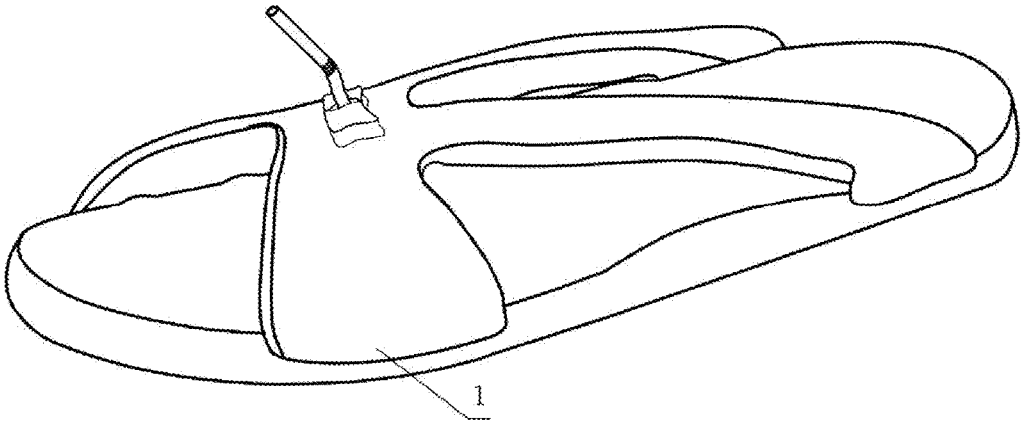
FIG. 7 is a schematic diagram of an inflatable shoe-shaped soft bag of the portable inflatable foldable shoe of the embodiment 2 of the present application.
Figure 8:
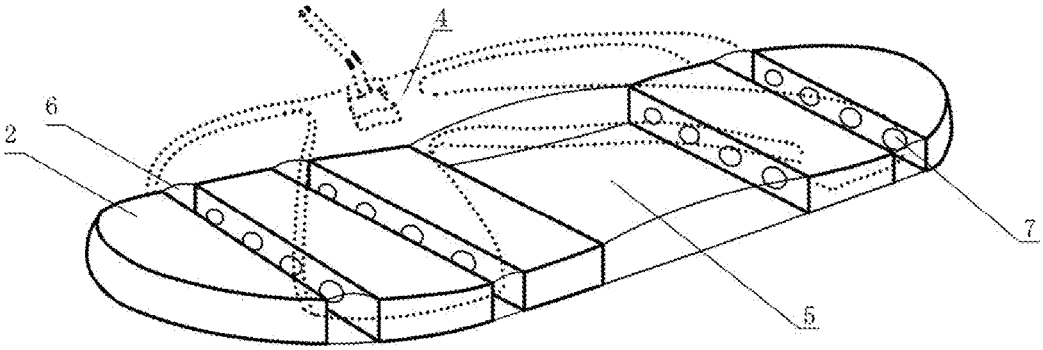
FIG. 8 is a connecting schematic diagram of the inflatable shoe-shaped soft bag and a solid bearing block of the portable inflatable foldable shoe of the embodiment 2 of the present application.
Figure 9:
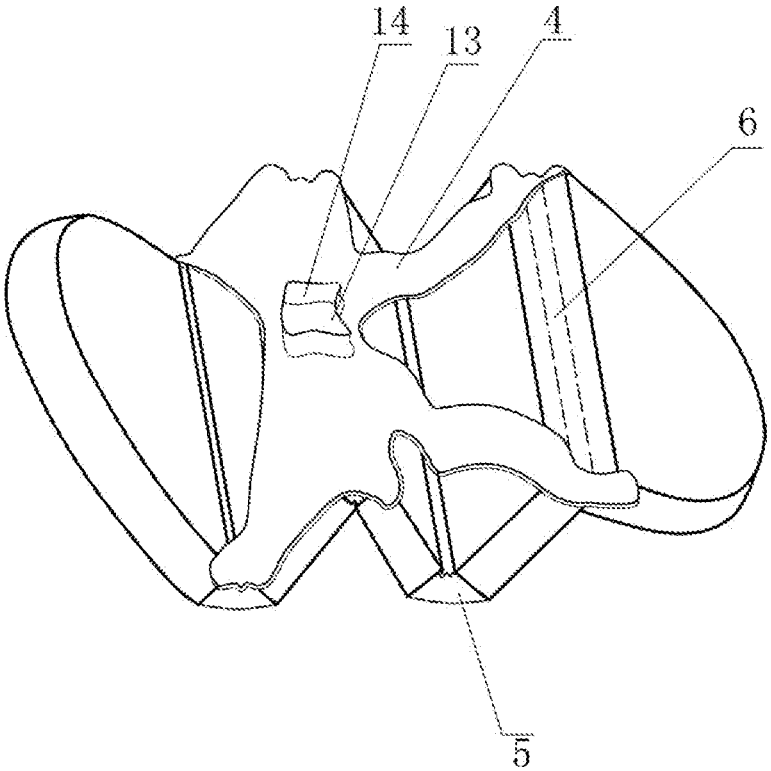
FIG. 9 is a folding schematic diagram of the portable inflatable foldable shoe of the embodiment 2 of the present application.
Figure 10:
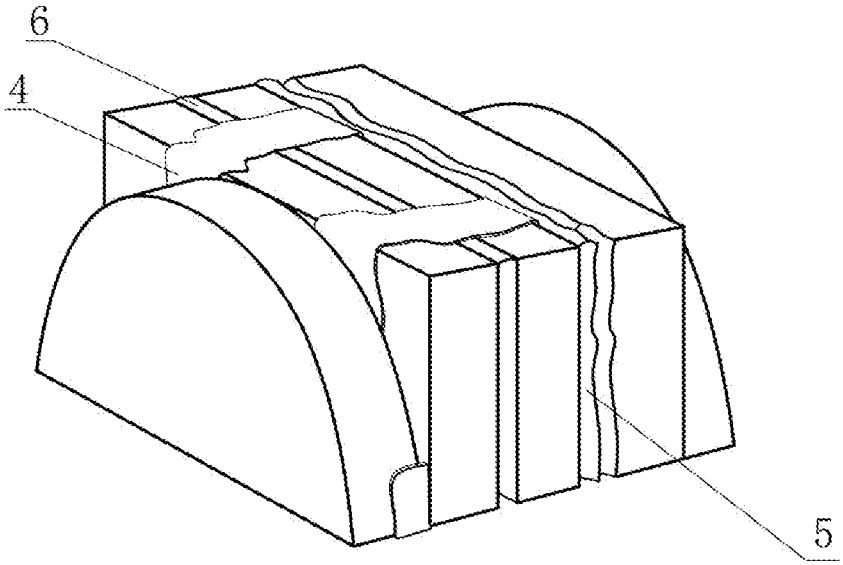
FIG. 10 is a folding finishing schematic diagram of the portable inflatable foldable shoe of the embodiment 2 of the present application.
Figure 11:
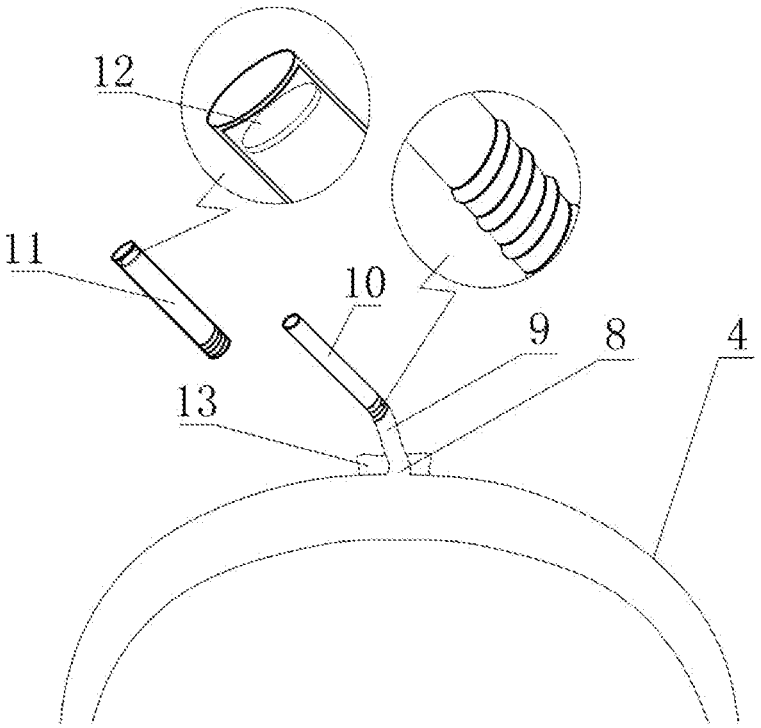
FIG. 11 is a schematic diagram of an air sealing hose, an air nozzle and a cleaning air nozzle cover of the portable inflatable foldable shoe of the embodiment 2 of the present application.
Figure 12:
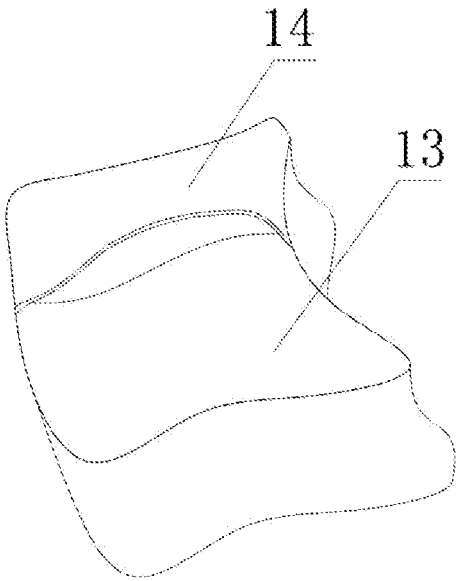
FIG. 12 is a schematic diagram of a fixing bag and a sealing piece of the portable inflatable foldable shoe of the embodiment 2 of the present application.
Figure 13:
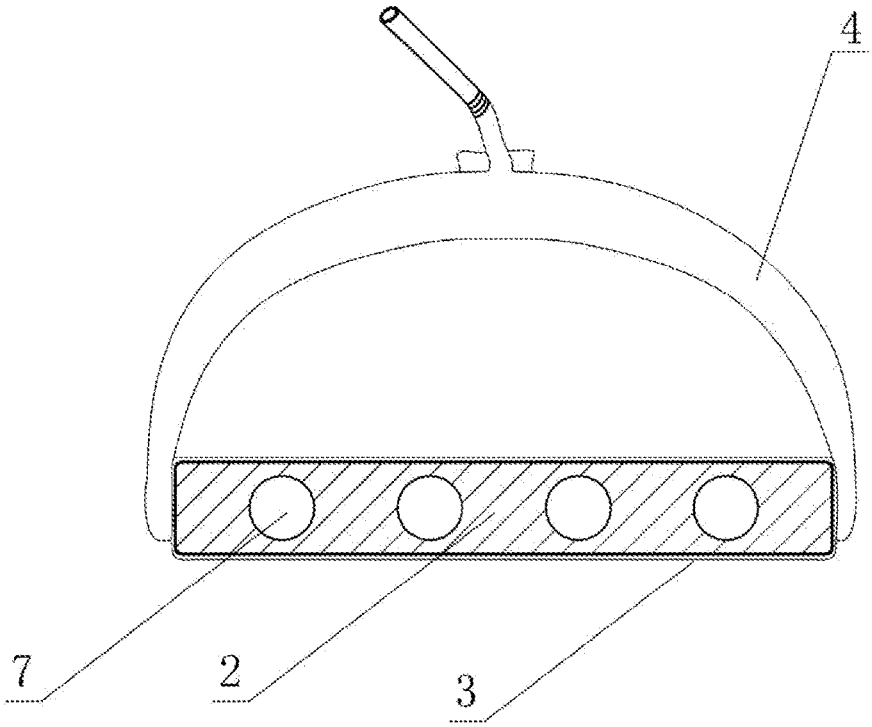
FIG. 13 is a cross-section schematic diagram of a solid bearing block of the portable inflatable foldable shoe of the embodiment 2 of the present application.

A portable inflatable foldable shoe, as shown in FIGS. 1-3, comprises an inflatable shoe-shaped soft bag 1 and solid bearing blocks 2;

The inflatable shoe-shaped soft bag 1 is of a hollow cavity structure, made of high density polyethylene and comprises a sole 3 and a vamp 4;

Three solid bearing blocks 2 are arranged, are distributed in two regions of a front sole part and a heel part of the sole, the front sole part is provided with two solid bearing blocks, the heel part is provided with one solid bearing block, the sole 3 is divided into a middle supporting cavity 5 and a supporting folding cavity 6 by the solid bearing blocks 2, the region connected with the two regions of the front sole region and the heel region is the middle supporting cavity 5, the region connected with the adjacent bearing blocks is the supporting folding cavity 6, each solid bearing block 2 has upper, lower, left and right surfaces, which are tightly adhered to the corresponding inner wall of the shoe-shaped cavity of the sole 3 with glue, each solid bearing block 2 is provided two air passages 7 that run through the entire block, is made of plastic and a distance between the adjacent solid bearing blocks is 3.5 cm;

The inflatable shoe-shaped soft bag 1 is provided with an air hole 8, the vamp 4, the middle supporting cavity 5, the supporting folding cavity 6, the air passages 7 and the air hole 8 form an integral cavity structure with air flow, and the inflatable shoe-shaped soft bag is inflated and deflated through the air hole 8.

The portable inflatable foldable shoe is simple in structure, the solid bearing blocks are arranged, thereby effectively solving the problem that other inflatable shoes are insufficient in supporting force and pressed by a body weight of a user, and the problems of uneven stressing and unstable walking of other inflatable shoes are also solved; the solid bearing blocks are designed according to a shoe shape, so that the upper, lower, left and right surfaces of the solid bearing blocks can be tightly adhered to the corresponding inner wall of the shoe-shaped cavity, therefore, the solid baring blocks are firmly fixed without moving and a wearer feels stable and comfortable during walking; the solid bearing blocks are provided with 2 air passages in the cross section parts, and due to such design, the air flow of the integral cavity structure in the inflatable shoe-shaped soft bag cannot be obstructed in a case that the solid bearing blocks are arranged in the inflatable shoe-shaped soft bag and are tightly adhered to the inner wall thereof, thereby achieving a supporting action for the whole shoe body; the supporting folding cavity is arranged and has actions of supporting the solid bearing blocks at two sides by a supporting force formed after the cavity is inflated and preventing the solid bearing blocks from drooping, meanwhile, during storage, the solid bearing blocks having certain thickness can be folded due to the gaps between the solid bearing blocks by only releasing air in the supporting folding cavity, thereby reducing the size during storage and facilitating carrying; the middle supporting cavity is arranged, a hollow inflating cavity is adopted in a relative non-stressing part of the sole of a foot, achieves a supporting action after being inflated to support the front sole region and the heel region connected to each other of the sole into a flat and stiff whole, the volume can be compressed to be minimal after air leakage, thereby realizing the design aim of reducing the storage size, meanwhile, due to the middle supporting cavity, the solid bearing blocks are greatly reduced and the light weight of the shoe bodies is realized; when in use, the air hole is blown till the integral structure is filled with air, the sealing of the inflatable shoe is realized by a valve core, people can wear the shoes to walk, when not in use, an outer cover of the valve core is loosed to deflate the inflatable shoe and the shoe is portable after deflating.

Embodiment 2

A portable inflatable foldable shoe, as shown in FIGS. 4-12, comprises an inflatable shoe-shaped soft bag 1 and solid bearing blocks 2;

The inflatable shoe-shaped soft bag 1 is of a hollow cavity structure, made of polyethylene plus nylon, is coated with a silane superhydrophobic material at the surface and comprises a sole 3 and a vamp 4;

Five solid bearing blocks 2 are arranged, are distributed in two regions of a front sole part and a heel part of the sole, the front sole part is provided with three solid bearing blocks, the heel part is provided with two solid bearing blocks, the sole 3 is divided into a middle supporting cavity 5 and a supporting folding cavity 6 by the solid bearing blocks 2, the region connected with the two regions of the front sole region and the heel region is the middle supporting cavity 5, the region connected with the adjacent bearing blocks is the supporting folding cavity 6, each solid bearing block 2 has upper, lower, left and right surfaces, which are tightly adhered to the corresponding inner wall of the shoe-shaped cavity of the sole 3 in a high frequency thermal fusion manner, each solid bearing block 2 is provided 4 air passages 7 that run through the entire block, is made of rubber and a distance between the adjacent solid bearing blocks is 0.5 cm; the part of the middle supporting cavity 5 correspondingly contact with a foot arch is thickened; the supporting folding cavity is slightly higher than the upper surfaces of the solid bearing blocks 2 at two sides after being inflated;

The inflatable shoe-shaped soft bag 1 is provided with an air hole 8, the vamp 4, the middle supporting cavity 5, the supporting folding cavity 6, the air passages 7 and the air hole 8 form an integral cavity structure with air flow, and the inflatable shoe-shaped soft bag is inflated and deflated through the air hole 8; the air hole 8 and the air sealing hose 9 are connected, the air sealing hose 9 is a plastic hose and is 2.5 cm long; the air hole 8 is connected with an air nozzle 10 by the air sealing hose 9, a cleaning air nozzle cover 11 covers air nozzle 10, a connecting manner between the air nozzle 10 and the cleaning air nozzle cover 11 is threaded connection, an airtight gasket 12 is arranged at the top of the cleaning air nozzle cover 11, and the camp 4 is provided with a fixing bag 13 of which an opening is blocked by a sealing piece 14;

A durable antiskid cushion layer 15 made of plastic is arranged under the sole 3, and one surface of the durable antiskid cushion layer stepping on the ground is provided with antiskid textures.

According to the present application, the solid bearing blocks are arranged, thereby effectively solving the problem that other inflatable shoes are insufficient in supporting force and pressed by a body weight of a user, and the problems of uneven stressing and unstable walking of other inflatable shoes are also solved; the solid bearing blocks are designed according to a shoe shape, so that the upper, lower, left and right surfaces of the solid bearing blocks can be tightly adhered to the corresponding inner wall of the shoe-shaped cavity, therefore, the solid baring blocks are firmly fixed without moving and a wearer feels stable and comfortable during walking; the solid bearing blocks are provided with four air passages in the cross section parts, and due to such design, the air flow of the integral cavity structure in the inflatable shoe-shaped soft bag cannot be obstructed in a case that the solid bearing blocks are arranged in the inflatable shoe-shaped soft bag and are tightly adhered to the inner wall thereof, thereby achieving a supporting action for the whole shoe body; the supporting folding cavity is arranged and has actions of supporting the solid bearing blocks at two sides by a supporting force formed after the cavity is inflated and preventing the solid bearing blocks from drooping, meanwhile, during storage, the solid bearing blocks having certain thickness can be folded due to the gaps between the solid bearing blocks by only releasing air in the supporting folding cavity, thereby reducing the size during storage and facilitating carrying; the middle supporting cavity is arranged, a hollow inflating cavity is adopted in a relative non-stressing part of the sole, achieves a supporting action after being inflated to support the front sole region and the heel region connected to each other of the sole into a flat and stiff whole, the volume can be compressed to be minimal after air leakage, thereby realizing the design aim of reducing the storage size, meanwhile, due to the middle supporting cavity, the solid bearing blocks are greatly reduced and the light weight of the shoe bodies is realized; the cleaning air nozzle cover is designed to ensure sanitation and cleanliness of the air nozzle; the airtight gasket is made of the elastic, press-resistant and tough material and is placed in the air nozzle cover, when the air nozzle cover is screwed down on the air nozzle, the air nozzle cover extrudes the airtight gasket toward the air nozzle opening till the airtight gasket is tightly attached to the air nozzle opening, and thus air in the cavity of the shoe cannot be released from the air nozzle opening; the fixing bag and sealing piece are arranged to prevent the air sealing hose and air nozzle from swinging to influence walking during walking, and the portable inflatable foldable shoes are also concise and elegant in appearance, and the air nozzle is further protected from pollution.

Above content is further detailed description on the present application in combination with specific preferable embodiments and it should not be considered that specific implementation of the present application is limited to the description. For those ordinary skilled in the art of the present application, plural equivalent substitutions or obvious modifications with the same performance or purpose without departing from the inventive concept of the present application belong to a patent protection scope determined by claims of the present application.

What is claimed is:

1. A portable inflatable foldable shoe, comprising an inflatable shoe-shaped soft bag and solid bearing blocks, wherein the inflatable shoe-shaped soft bag is of a hollow cavity structure and at least comprises a sole and a vamp;

wherein more than two solid bearing blocks are positioned inside the inflatable shoe-shaped soft bag and are distributed in two regions of a front sole part and a heel part of the sole, the sole is divided into a middle supporting cavity and a supporting folding cavity by the solid bearing blocks, the region connected with the two regions of the front sole region and the heel region is the middle supporting cavity, the region connected with the adjacent solid bearing blocks is the supporting folding cavity, each solid bearing block has upper, lower, left and right surfaces, at least one surface is tightly adhered to a corresponding inner wall of a shoe-shaped cavity of the sole, and each solid bearing block is provided with more than one air passages that run through the block;

wherein the inflatable shoe-shaped soft bag is provided with an air hole, the vamp, the middle supporting cavity, the supporting folding cavity, the air passages and the air hole form an integral cavity structure with air flow, and the inflatable shoe-shaped soft bag is inflated and deflated via the air hole.

2. The portable inflatable foldable shoe according to claim 1, wherein a tightly adhering manner of the at least one surface being tightly adhered is gluing or high frequency thermal fusion.

3. The portable inflatable foldable shoe according to claim 1, wherein a distance between the adjacent solid bearing blocks is more than 0.5 cm.

4. The portable inflatable foldable shoe according to claim 1, wherein a distance between the adjacent solid bearing blocks is 1.0-3.5 cm.

5. The portable inflatable foldable shoe according to claim 1, wherein the air hole is connected to an air sealing hose.

6. The portable inflatable foldable shoe according to claim 5, wherein the air hole is connected with an air nozzle via the air sealing hose.

7. The portable inflatable foldable shoe according to claim 6, wherein a cleaning air nozzle cover covers the air nozzle and the air nozzle and the cleaning air nozzle cover is connected through threaded connection.

8. The portable inflatable foldable shoe according to claim 7, wherein an airtight gasket is arranged at the top of the cleaning air nozzle cover.

9. The portable inflatable foldable shoe according to claim 5, wherein the vamp is provided with a fixing bag of which an opening is blocked by a sealing piece.

10. The portable inflatable foldable shoe according to claim 1, wherein a part of the middle supporting cavity with contact to a foot arch is thickened.

11. The portable inflatable foldable shoe according to claim 1, wherein a durable antiskid cushion layer is arranged under the sole, and one surface of the durable antiskid cushion layer stepping on the ground is provided with antiskid textures.

12. The portable inflatable foldable shoe according to claim 11, wherein the durable antiskid cushion layer is made of plastic, silica gel or rubber.

13. The portable inflatable foldable shoe according to claim 1, wherein the supporting folding cavity after being inflated is slightly higher than the upper surfaces of the solid bearing blocks at two sides.

14. The portable inflatable foldable shoe according to claim 1, wherein the inflatable shoe-shaped soft bag is made of high density polyethylene, polyetherimide or polyethylene plus nylon.

15. The portable inflatable foldable shoe according to claim 1, wherein the surface of the shoe is coated with a hydrophobic or superhydrophobic material coating or made of a hydrophobic or superhydrophobic material.

16. The portable inflatable foldable shoe according to claim 15, wherein the hydrophobic or superhydrophobic material is alkane, silane, hydrofluoroalkane, ferroferric oxide nano or monocrystalline silicon.

17. The portable inflatable foldable shoe according to claim 1, wherein the shoe is a slipper, a sandal with a back strip or a shoe with fully closed vamp.

* * * * *